United States Patent [19]

Cheh

[11] Patent Number: 5,072,745

[45] Date of Patent: Dec. 17, 1991

[54] HAIR EXTENSION PROCESS

[76] Inventor: Byung J. Cheh, 2361 Achilles Dr., Los Angeles, Calif. 90046

[21] Appl. No.: 545,594

[22] Filed: Jun. 29, 1990

[51] Int. Cl.[5] ..... A41G 3/00

[52] U.S. Cl. ..... 132/201

[58] Field of Search ..... 132/200, 201, 53, 56

[56] References Cited

U.S. PATENT DOCUMENTS

| | | | |
|---|---|---|---|
| 3,032,042 | 5/1962 | Meehan | 132/201 |
| 3,295,534 | 1/1967 | Dorkin | 132/201 |
| 4,267,850 | 5/1981 | Barrett | 132/270 |
| 4,372,330 | 2/1983 | Nelson | 132/201 X |
| 4,934,387 | 6/1990 | Megna | 132/201 |
| 4,947,877 | 8/1990 | Meyer et al. | 132/53 X |

*Primary Examiner*—John J. Wilson
*Assistant Examiner*—Jeffrey A. Smith
*Attorney, Agent, or Firm*—G. Donald Weber, Jr.

[57] ABSTRACT

A process by which loose hair is added to a person's existing hair in order to enhance the appearance of the hair. The process involves the steps of applying a hot melt adhesive to bond the loose hair to the existing hair and applying a sealant over the adhesive to maintain the added hair in place.

9 Claims, 1 Drawing Sheet

HAIR EXTENSION PROCESS

BACKGROUND

1. Field of the Invention

This invention is directed to hair enhancement techniques, in general, and to a method wherein finer scale hair enhancement techniques can be utilized, in particular.

2. Prior Art

There are many techniques utilized in today's technology for enhancing or improving the amount of hair displayed on a person's head. In the instance of a totally bald head, the techniques are somewhat limited to hair implantation, wigs, toupees or other prosthetic devices. These techniques are well-known and achieve varying degrees of acceptability and satisfaction to the user.

In the instance wherein the person is not completely bald but rather is suffering from thinning hair or the like, other techniques are available. One technique is to shave the head and proceed as if completely bald. This is usually not acceptable to the person involved.

In many cases the existing hair has been enhanced by the addition of other loose or false hair. Typically, the best appearance is achieved by using loose hair which may be obtained from cutting the hair of the individual, obtaining hair from other sources and by using artificially produced but realistic looking hair. In the known techniques, relatively large clumps of existing hair are used to attach the loose hair. In other words, the loose hair is effectively joined to or attached to the existing hair. However, this tends to have a somewhat blotchy or clumpy look which is not terribly pleasing.

PRIOR ART STATEMENT

A preliminary search has not been conducted. The known techniques are available in the general literature. No patents are known.

SUMMARY OF THE INSTANT INVENTION

This invention is directed to a two-step process for enhancing the appearance of the hair of human being. In particular, the process is used to enhance instances of thinning hair.

In the first step of the process, a hot melt adhesive is applied to bond loose hair to the person's own hair. This bonding takes place quite close to the scalp.

In the second step, a sealant is applied over the adhesive to prevent the adhesive from becoming loosened or destroyed and thereby prevents the added hair from becoming detached from the existing hair.

During the operation, the scalp is protected with a hard plastic shield. The process can be used with an individual hair technique or with a micro-weft techinque.

DESCRIPTION OF THE PREFERRED EMBODIMENT

Figure 1:
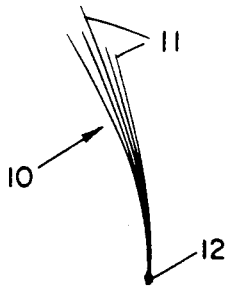
FIGS. 1 through 4 demonstrate the steps of applying loose hairs to individual hairs in the individual hair-by-hair process.

Referring now to FIGS. 1 through 4, there are shown the several steps involved in the individual hair application method. In this method, individual hairs 11 (or small bundles of hairs 10) are applied to the hair of the individual patient or customer. In particular, as shown in FIG. 1, a hair 11 or a very small bundle of hair 10 (e.g., two to ten hairs) is joined together by a small dab of primary adhesive 12. The adhesive is applied at one end of the hairs to cause these hairs to join together. (While the method preferably contemplates the use of one through ten hairs, more hairs can be combined in a bundle if so desired.) The adhesive which is applied to the ends of the hairs is, typically, National's Instaweld 34-3131 hot melt adhesive.

Figure 2:
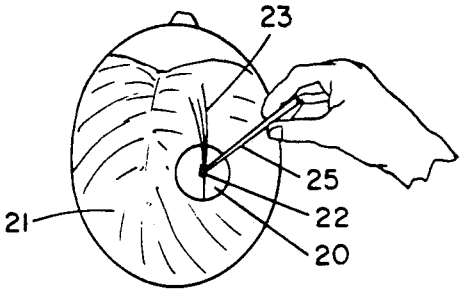

As shown in FIG. 2, a hair shield 20 is placed over the area of the head 21 where the hair is to be attached. In particular, the hair shield 20 is fabricated of a hard plastic such as styrene and includes a small hole 22 drilled therein. (Of course, multiple holes can be provided, if so desired.) The shield 20 is placed over the hair which is attached to and growing in the scalp. The existing hair 23 (or hairs) is pulled through the small hole 22 in the shield 20. Typically, a hook 25 such as a crochet hook or the like is used but other techniques are available. The number of hairs which are pulled through the hair shield is, again, typically one through ten but more may be used, if desired.

As noted above, the smaller the number of hairs which are used as the attachment and the attached, the finer and more aesthetically pleasing the arrangement which can be achieved.

Figure 3:
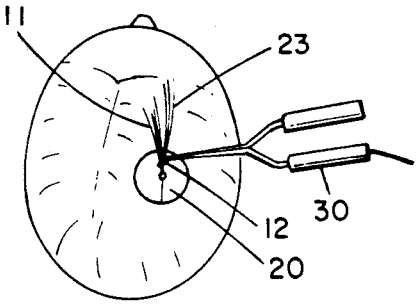

As shown in FIG. 3, an application tool 30 is used to melt the adhesive 12 on the loose hairs 11 which have been fabricated according to FIG. 1. The melted adhesive is then also applied to the hairs which have been drawn through the hole 22 in the shield 20 as shown in FIG. 2. The adhesive is applied at or near the root of the existing hair. Typically, this attachment is effected at approximately one-eighth to one-quarter of an inch from the scalp. The application tool is then removed whereupon the adhesive recongeals and resets thereby joining the loose hair 11 to the existing hair 23 on the scalp. Thus, existing hair acts as a support or anchor for the loose hair.

Figure 4:
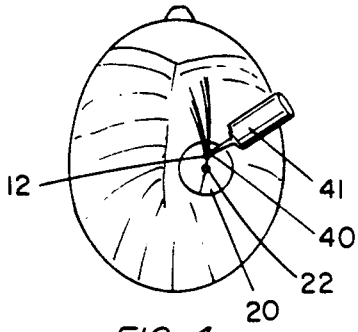

As shown in FIG. 4, a sealant 40 is applied over the adhesive 12 which has, at this point, reset into a substantially solid material. Typically, the sealant can comprise the S-Dine 800 instant set adhesive. The sealant 40 is applied by means of a plastic bottle 41 with a small opening to regulate the flow of the sealant. The sealant 40 is operative to extend the bond life of the adhesive by preventing the adhesive from being attacked by water, hair treatment materials or the like. The sealant 40 is also advantageous inasmuch as the amount of adhesive which is utilized is quite small. That is, a minimal amount of adhesive is used because the amount of hair used in each instance is also quite small.

Figure 5:
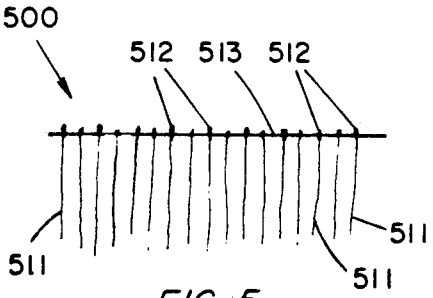
FIGS. 5 through 8 demonstrate the steps of applying loose hairs in a micro-weft called the micro-weft hair-by-hair process.

Referring now to FIG. 5, there is shown a micro-weft 500 of "loose" hair 511 which has been previously prepared. Typically, a plurality of individual hairs 511 are attached to a thin, transparent thread 513 in a single row. The thread 513 can be a thin strand of nylon or the like. The weft consists of a plurality of individual hairs 511 which are attached to the thread 513 on a side-by-side basis. The attachment is, typically, accomplished by tying the individual hairs to the strand. Each of the individual tied hairs 511 can also be held to the thread 513 by a suitable adhesive 512 drop. In addition, the weft is pre-treated with adhesive for attachment to existing hair.

Figure 6:
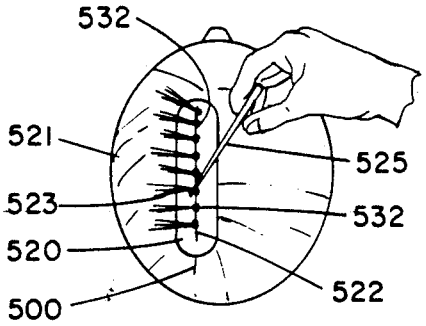

As shown in FIG. 6, a weft shield 520 is placed over the hair 521 in much the same manner as the naturally existing hair shield 20 shown in FIG. 2. However, the weft shield 520 includes a small slot 522 (or a plurality of small holes 532 joined together by a narrow slot) through which the existing hairs 521 on the scalp can be pulled. Again, the number of hairs pulled through the weft shield 520 are relatively small, i.e., on the order of one to ten hairs at a clump. (Of course, more hair can be used if desired.) The hairs 521 are pulled through the openings 532 in weft shield 520 using a hook 525, as noted before. Of course, the weft 500 (see FIG. 7) may be positioned horizontally, vertically or diagonally on the scalp.

Figure 7:
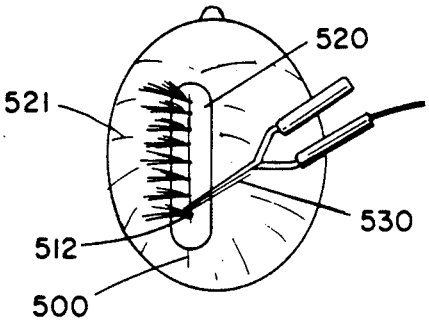

As shown in FIG. 7, the pre-applied adhesive on the weft are melted by application tool 530 (similar to tool 30 in FIG. 3) and applied to the existing hair 521 "globs" 512 (see FIG. 5). This melted adhesive is used to bond the micro-weft 500 to the existing hair 521. Again, the bonding is accomplished approximately one-eighth to one-quarter of an inch from the scalp and has the same effect noted above for the individual hairs.

Figure 8:
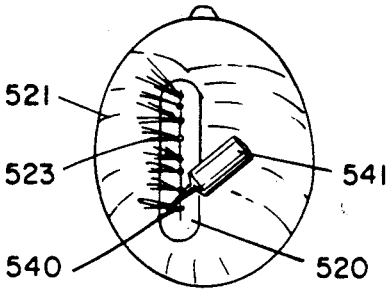

As shown in FIG. 8, a sealant 540 is applied over the primary adhesive 512 by means of applicator 541 to complete the bonding process and has the same the effect described relative to FIG. 4. The shield 520 is removed by passing the weft through the slot 522. The enhanced hair treatment is completed as described above.

Thus, there is shown and described a process for attaching very small numbers of loose hairs to relatively small numbers of existing hairs on a person's head. The process permits a finer scale hair enhancement than is permitted in conventional or known hair extensions or enhancement techniques.

Because a relatively small amount of hair is used for each application and, furthermore, because no base material is required (as in a wig), the end result of this process is a more natural looking hair enhancement than is obtained through the use of hair piece or a wig. Moreover, in the past, there has been no surgical method of helping those with thinning hair (as opposed to instances where hair is completely absent) other than shaving the head and using a hair piece. Through the method described herein, a more aesthetically pleasing hair enhancement technique is provided and, as well, longer life of the enhanced hair is provided.

Thus, there is shown and described a unique design and concept of a hair enhancement process. While this description is directed to particular embodiments, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

I claim:

1. A process for enhancing the appearance of hair on a person's head comprising the steps of:

obtaining at least one loose hair;

applying a primary adhesive to one end of said loose hair;

placing a shield over the existing hair on a person's head;

pulling at least one existing hair on a person's head through an opening in said shield;

melting the adhesive on the loose hair and attaching the loose hair to the existing hair;

said loose hair is attached to said existing hair about $\frac{1}{8}$ to $\frac{1}{4}$ inch from the scalp of the person's head; and applying a protective sealant over the adhesive.

2. The process recited in claim 1 wherein, said shield has a plurality of openings therethrough whereby a plurality of hairs can be pulled through said shield.

3. The process recited in claim 1 wherein, the number of existing hairs on a person's head which is pulled through the opening in said shield is maintained at a minimum.

4. The process recited in claim 1 wherein, said shield is formed of a hard plastic with a single hole therethrough.

5. The process recited in claim 1 wherein, a hook is used to pull said existing hair through said shield.

6. A process for enhancing the appearance of hair on a person's head comprising the steps of:

obtaining a plurality of loose hairs;

applying a primary adhesive to one end of each of said loose hairs;

joining said plurality of loose hairs to a common strand;

applying the adhesive to said strand, placing a shield over the existing hair on a person's head;

pulling at least one existing hair on a person's head through an opening in said shield;

melting the adhesive on said strand and attaching said strand to the existing hair; and applying a protective sealant over the adhesive.

7. The process recited in claim 6 wherein, said shield has a plurality of openings therethrough and a narrow slit interconnecting at least some of said plurality of openings.

8. The process recited in claim 6 wherein, said loose hairs are joined to said strand by tying.

9. The process recited in claim 6 wherein, said strand is fabricated of nylon.

* * * * *